US012557899B2

(12) United States Patent
Pfeifer et al.

(10) Patent No.: US 12,557,899 B2
(45) Date of Patent: Feb. 24, 2026

(54) CARRYING ARRANGEMENT

(71) Applicant: Andreas Stihl AG & Co. KG, Waiblingen (DE)

(72) Inventors: Markus Pfeifer, Winnenden (DE); Simon Haug, Waiblingen-Hohenacker (DE); Harald Mang, Winnenden (DE); Maren Langhammer, Leutenbach (DE); Tobias Würschum, Remseck am Neckar (DE); Samuel Finkbeiner, Schwaikheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 118 days.

(21) Appl. No.: 18/410,745

(22) Filed: Jan. 11, 2024

(65) Prior Publication Data

US 2024/0237810 A1 Jul. 18, 2024

(30) Foreign Application Priority Data

Jan. 12, 2023 (DE) ..... 10 2023 100 580.4

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/144* (2013.01); *A45F 2003/146* (2013.01)

(58) Field of Classification Search
CPC ..... A45F 2003/003; A45F 2003/144; A45F 2003/146; A45F 2003/007; A45F 2003/025; A45F 2003/045; A45F 3/047; A45F 2003/142; A45F 3/14
See application file for complete search history.

(56) References Cited

U.S. PATENT DOCUMENTS 178,545 A * 6/1876 Merriam ..... A45F 3/047 224/636
393,555 A * 11/1888 Griffin ..... A47D 13/02 182/4
4,487,347 A * 12/1984 Zegar ..... A45F 3/04 224/259
5,529,229 A * 6/1996 Fier ..... A45F 3/04 224/652
6,152,343 A * 11/2000 Shin ..... A45F 3/14 224/264
6,378,746 B1 * 4/2002 Miller ..... A47D 13/02 224/264
2018/0206619 A1 * 7/2018 Picking ..... A45F 3/14

* cited by examiner

*Primary Examiner* — Jack W Lavinder
(74) *Attorney, Agent, or Firm* — Walter Ottesen, P.A.

(57) ABSTRACT

A carrying arrangement for carrying loads, in particular tools and/or implements, includes at least one carrying belt, in particular a shoulder belt and/or a hip belt, on the body of a user. The length of the carrying belt is adjustable in order to be adapted to the body size of the user and/or the carrying situation. The carrying belt is formed from at least three belt segments which can be positioned relative to one another in order to adjust the length of the carrying belt. A first belt segment is adjustable in discrete increments relative to a second belt segment and a third belt segment is steplessly adjustable relative to the first belt segment and/or the second belt segment.

19 Claims, 5 Drawing Sheets

CARRYING ARRANGEMENT

CROSS-REFERENCE TO RELATED APPLICATIONS

This application claims priority of German patent application no. 10 2023 100 580.4, filed Jan. 12, 2023, the entire content of which is incorporated herein by reference.

TECHNICAL FIELD

The disclosure relates to a carrying arrangement for carrying loads.

BACKGROUND

Carrying arrangements for carrying loads, which are arranged via belts on the body of a user, are known from the prior art. In order to adapt the carrying arrangement to the body size, buckles are provided on the belts, the length of the belt loops being able to be reduced thereby when the free belt ends protruding from the buckles are pulled. A drawback with this construction is the formation of long free belt ends which hang in the way of the user of the carrying arrangement, which become entangled with other belts or which become soiled when the carrying arrangement is put down. To this end, in the prior art the solution is known to provide receiving pockets or other means for stowing the free belt ends. The provision of these pockets increases the production effort and the manufacturing costs of the carrying arrangement. Moreover, after stowing the belt ends in the pocket the user is no longer able to carry out a rapid adjustment of the length so that the user no longer adapts the carrying arrangement to their needs and/or the current carrying situation and the carrying comfort and the effectiveness of the carrying arrangement are reduced.

SUMMARY

Thus it is an object to provide a carrying arrangement which has an improved adjustment of the length.

The disclosure relates to a carrying arrangement for carrying loads, in particular tools and/or implements, wherein the carrying arrangement can be arranged with at least one carrying belt, in particular a shoulder belt and/or a hip belt, on the body of a user, wherein the length of the carrying belt is adjustable in order to be adapted to the body size of the user and/or the carrying situation. According to the disclosure, the carrying belt is formed from at least three belt segments which can be positioned relative to one another in order to adjust a length of the carrying belt, wherein a first belt segment is adjustable in discrete increments relative to a second belt segment and a third belt segment is steplessly adjustable relative to the first belt segment and/or the second belt segment.

A product which is formed, in particular, substantially from textile components which can be put on/worn by a user, in order to fasten thereto one or more load(s) to be carried and thereby to permit the user to carry the load(s) in a more efficient and/or more ergonomic manner, is denoted as a carrying arrangement. The carrying arrangement is fixed/can be fixed by at least one carrying belt to the body of the user, preferably to the shoulder and/or hip region. The carrying arrangement can include a hip belt to which the load is fastened. The carrying arrangement can include a shoulder belt to which the load is fastened. The carrying arrangement can include a back plate to which the load is fastened and which is connected to the user via at least one shoulder belt and, in particular, a hip belt. The back plate can be formed, in particular, by a plastics component. Instead of the back plate, it is also possible to provide a back part made of textile and/or compressed foam.

The carrying belt, in particular, is a substantially textile product, wherein it can have buckles or similar connecting elements made of metal or plastics. A belt segment is understood to mean a part of the carrying belt which forms the carrying belt together with at least one further belt segment. The belt segment has an elongated basic shape and a first end and second end relative to the longitudinal direction of the belt segment, with a length of the belt segment extending therebetween. In an embodiment, the belt segment expediently has a substantially uniform cross section and/or construction in the longitudinal direction of the belt segment. It can be provided that a belt segment is formed by a flat band or, in particular, an elongated cushion part.

The load to be carried has, in particular, a weight of less than 50 kg, in particular less than 20 kg. The load can include one or more tools, in particular hand tools, such as for example an axe, pruning shears, a measuring tool or similar hand tool which is generally required in the gardening/forestry or construction industries and/or also an implement, in particular a motor-driven working implement, such as for example a brush cutter, a garden pruner, a blower or other hand-held working implement and/or the battery pack thereof. The carrying arrangement can accordingly simplify the transport and/or the use of the tool and/or implement and/or the battery pack, by at least one part of the weight force and/or operating force of the tool and/or implement and/or battery pack being received via the carrying arrangement and being forwarded to the body carrying the load.

In order to be adapted to the body size of the user and/or the carrying or working situation, it is possible to adjust the length of the carrying belt, in particular the shoulder belt and/or the hip belt, by an adjustment length. The adjustment of the length of the carrying belt takes place at least in a stepless portion and in a discrete portion, the belt segments associated with the carrying belt being able to be adjusted thereby relative to one another. A first belt segment is adjustable relative to a second belt segment in discrete increments, that is, predefined spacings. The first or second belt segment is also steplessly adjustable relative to a third belt segment. An overlap of the belt segments is changed as a result of the relative adjustment of the belt segments. The length of the carrying belt is increased by a reduction in the overlap and the length of the carrying belt is reduced by an increase in the overlap. The adjustment length corresponds, in particular, to the sum of the changes of the individual overlaps of the belt segments of the carrying belt. The possible overlap is fixed structurally by the number and the size of the discrete increments or the selected length of the belt segment which can be pulled through the second fixation device. The free belt end overlaps the same or another belt segment.

By the presence of the discrete approximate adjustment and the stepless fine adjustment, the adjustment length is divided between both fixation devices and it is possible to reduce the length which has to be kept on the second fixation device for the stepless adjustment of the length. As a result, the drawback of the prior art is remedied, so that even if the carrying arrangement is set to a small size, long free belt ends which hinder the user are not produced. The largest part of the adjustment length is provided by the adjustment of the belt segments relative to one another in discrete approximate increments. The discrete adjustment expediently takes place initially when the carrying arrangement is first put onto a user, when the user can set the carrying arrangement according to their individual body size, for example to a small, average or large increment. The stepless adjustment serves, in particular, for fine adjustment, for example for adapting to thin or thick clothing of the user. For the stepless adjustment, therefore, only a small part of the adjustment length has to be kept, so that even when setting to the smallest size the maximum free belt end is reduced relative to the prior art.

In an embodiment, the first belt segment and the second belt segment can be fixed, in particular are fixed, by a first fixation device against a movement relative to one another, wherein the first fixation device is formed by a first part, in particular a holding projection protruding from the first belt segment, and a second, in particular bracket-shaped, part which is compatible therewith, and the first belt segment has the first part and the second belt segment has at least two second parts, wherein the second parts are arranged at a discrete spacing to one another in a longitudinal direction of the second belt segment, that is, in the direction of the length of the second belt segment. The discrete spacings are assigned, in particular, to the discrete increments of the adjustment of the length of the carrying belt. For the adjustment of the length, the first part of the first belt segment is accordingly detached from a second part of the second belt segment and connected to another second part of the second belt segment located at a discrete spacing. In this manner, the belt segments are positioned and fixed rapidly and simply relative to one another. The overlap of the first belt segment relative to the second belt segment is changed due to the repositioning of the first part. The achievable adjustment length of the discrete adjustment of the length of the carrying arrangement, that is, the repositioning between the minimum and maximum increment, can be fixed by the number of second parts present on the second belt segment and the spacing thereof from one another. The discrete spacings between adjacent second parts can be uniform or different from one another. If the carrying arrangement has a plurality of first belt segments, which are connected to one or more second belt segments, the range of the discrete increments of the second parts of the second belt segments is adapted to one another. In this manner, for example, a left-hand shoulder belt and a right-hand shoulder belt of the carrying arrangement can be adjusted symmetrically in discrete increments of the same size.

In an embodiment, the first belt segment is formed by a flat band-shaped section and the first part of the first fixation device is arranged on the first belt segment, in particular on the first end of the first belt segment. The first part of the first fixation device can be configured as a holding projection, in particular a hook-shaped holding projection, on the first belt segment. The holding projection is configured, in particular, integrally with the flat band and in an embodiment includes a reinforcing plate which is stitched into the flat band. The arrangement of the first part on the first belt segment, in particular on the first end of the first belt segment, permits a cost-effective manufacture of the first part. The first part is generated, in particular, by the flat band end being wrapped around once or repeatedly and stitched, so that a shape which protrudes from the belt segment, and in particular is hook-shaped, is produced. In order to increase the stiffness of the holding projection, in particular, a plastics plate can be inserted into the wrapped-around region.

In an embodiment, the holding projection is configured in a hook-shaped manner and overlaps the second part with a part of its length in the longitudinal direction of the second belt segment. A particularly resilient connection of the first part and second part is produced by the hook shape of the first part. In order to release the first part from the second part, the first belt segment can be initially displaced by the overlapping length of the hook-shaped holding projection in the longitudinal direction of the second belt segment, before it can then be pulled out of the second part in the opposing direction. A direct or indirect weight force of the load acting on the first belt segment pulls the hook so that it overlaps with the second, in particular bracket-shaped, part. Such a configuration is particularly robust and suitable, in particular, for use with a particularly dynamic movement of the carrier of the carrying arrangement.

The second belt segment is configured, in particular, to be cushioned at least in some sections. This enhances the carrying comfort of the carrying arrangement. Expediently, the regions of the belt on which the forces from the load are transferred from the carrying arrangement to the user are cushioned. A belt segment supported on the shoulder of the user, in particular, is configured to be cushioned in order to introduce the force comfortably into the shoulders. A belt segment supported on the hips of the user is configured, in particular, to be cushioned in order to introduce the force comfortably into the pelvis.

In an embodiment, the at least two second parts are arranged in the cushioned section of the second belt segment. It is provided, in particular, that the cushion is compressed for changing the discrete adjustment of the length. In order to reposition the first part of the first belt segment discretely, initially the first part has to be detached from the belt segment. The first part is configured, in particular, as a holding projection protruding from the belt segment. The first part, in particular the holding projection, is thicker than the second, in particular bracket-shaped, part. As the second part is arranged in the cushioned section, in particular the bracket is positioned on the cushion, the first part can be threaded through the second part by compressing the cushion. In order to connect the first part to the discretely spaced-apart second part, the first part is threaded through the second part by compressing the cushion. As soon as the first part is threaded through the second part, the compressed cushion is relieved of load again. The holding projection which is also compressed can also be relieved of load again and hooked onto the bracket. The first belt segment and the second belt segment are accordingly fixed to one another by the connection of the first part and second part, in particular the holding projection and bracket. The cushion pretensioned by the first belt segment increases the non-positive connection between the first belt segment and the second part, so that an inadvertent release of the first part and second part—even when the carrying belt has been put down and thus is relieved of load—is avoided. The compression of the cushion takes place in the simplest case when the belt is relieved of load, so that the discrete adjustment of the length, in particular, is not provided for the dynamic adjustment of the length during the use of the carrying arrangement.

In an embodiment, the third belt segment can be fixed, in particular is fixed, by a second fixation device against a movement relative to the first belt segment or the second belt segment, and the length of a free belt end protruding from the second fixation device is changed as a function of a position of the second fixation device which can be steplessly displaced relative to the longitudinal direction of the first or second belt segment. The second fixation device is expediently formed by a buckle, clip or the like at which at least one of the belt segments can be pulled through steplessly in order to increase the overlap and to reduce the length of the carrying belt. The other belt segment can also be pulled steplessly through this buckle, in order to provide a further overlapping length or adjustment length. In an embodiment, the other belt segment is connected, for example stitched in or reversibly hooked in, to the buckle with its end so as to be unchangeable in terms of length. The second fixation device is provided, in particular, for the dynamic adjustment of the length during the use of the carrying arrangement.

In an embodiment, the belt segment associated with the free belt end has a length of less than 50 cm, in particular less than 40 cm, quite in particular less than 25 cm. The free belt end extends from the second fixation device to the associated end of the belt segment. With a maximum possible shortening, the length of the free belt end can correspond to the length of the carrying belt, at most to the length of the belt segment. As a result, it is ensured that the free belt end is shorter than 50 cm, in particular shorter than 40 cm and quite in particular shorter than 25 cm. Since the second fixation device is generally not used in the end positions of the adjustment range, but instead dynamically therebetween, the free belt end is still significantly shorter than the associated length of the belt segment during the use of the carrying arrangement.

In an embodiment at least two, in particular at least three, quite in particular four, first belt segments can be fixed to a, in particular the same, second belt segment in discrete increments. By the provision of a plurality of first fixation devices, it is possible to increase the adjustment length, which can be provided by the discrete adjustment of the length, and thus to substitute a further portion of the steplessly adjustable adjustment length. The second, in particular cushioned, belt segment is used in a particularly efficient manner when a plurality of sets of second parts are arranged along the length of the belt segment. In particular, one set can be arranged in a first section and a further set can be arranged in a second different section. In an embodiment in which the second belt segment is supported on the shoulders of the user, the second belt segment has two front sections and at least one rear section, in particular two rear sections, and each of the sections has a set of two parts. In this manner, a carrying arrangement can be implemented with particularly short free belt ends.

In an embodiment, the carrying belt includes a shoulder belt and a hip belt, wherein the shoulder belt has at least the first belt segment and the second belt segment and the third belt segment is configured on the hip belt. Alternatively the third belt segment is part of the shoulder belt and, in particular, is connected to the hip belt so as to be unchangeable in terms of length. The third belt segment is fixed by the second fixation device relative to a further belt segment, specifically the first belt segment or the second belt segment. The length of the carrying belt is shortened by pulling on the free belt end protruding from the fixation device. The third fixation device is arranged, in particular, on the front of the user in order to achieve good accessibility of the free end during the use of the carrying arrangement. In an embodiment, the carrying belt has a cushioned second belt segment supported on the shoulders of the user, and a first belt segment extending on the front of the second belt segment in the direction of the hip belt. The first belt segment can be connected directly or indirectly, that is, via a further belt segment, to the hip belt. Accordingly, the third belt segment is configured on the hip belt or a belt segment associated with the shoulder belt. The belt segment(s) fixed to the hip belt can be connected, in particular, reversibly to the hip belt. In this manner, on the one hand, the shoulder belt can be easily cleaned or replaced and, on the other hand, the hip belt can be used with an alternative shoulder belt or without a shoulder belt.

BRIEF DESCRIPTION OF DRAWINGS

The invention will now be described with reference to the drawings wherein.

DETAILED DESCRIPTION

Figure 1A:
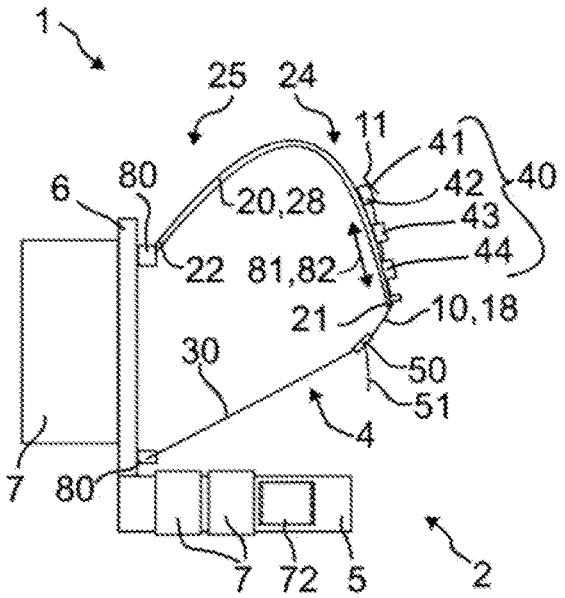
FIGS. 1A, 1B show a schematic side view of a carrying arrangement according to a first embodiment.
Figure 1B:
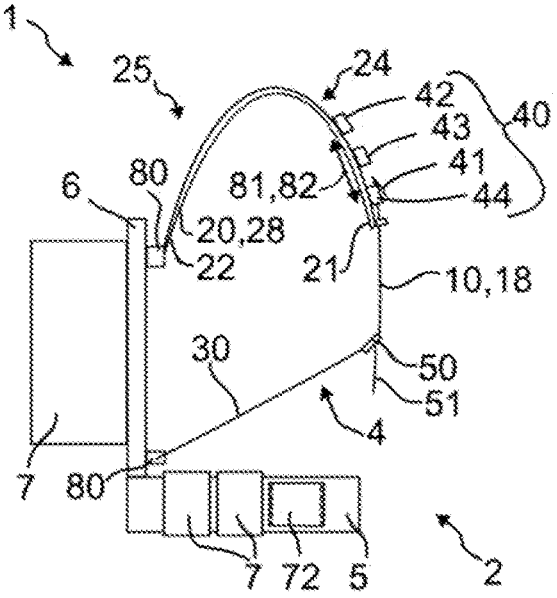

FIGS. 1A, 1B, 2A, 2B, 3 and 5 show schematically a carrying arrangement 1 with a carrying belt 2 which includes two shoulder belts 3, 4 and a hip belt 5. One or more loads 7 can be attached to the carrying arrangement 1. The load 7 can be, in particular, a battery pack, forestry tool or a motor-driven working implement which is transported or operated. To this end, a transport bracket 72 to which the load is connected can be provided on the carrying belt.

Figure 5:
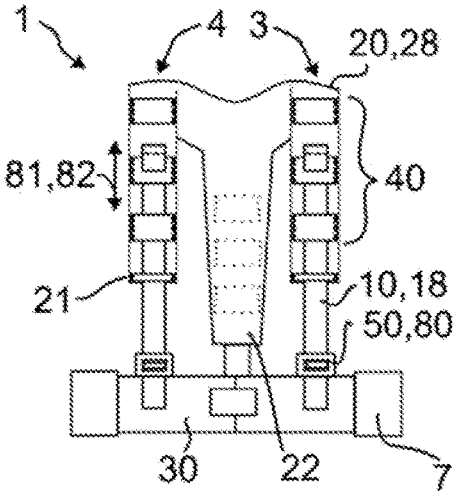
FIG. 5 shows a schematic front view of a carrying arrangement according to the third embodiment with an alternative shoulder belt.

The left-hand shoulder belt 3 which is not visible—from the viewpoint of the user—is identical to the right-hand shoulder belt 4. The shoulder belt 3, 4 includes a front section 24 and a rear section 25 relative to the user. In the embodiment according to FIGS. 1A and 1B the carrying arrangement 1 includes a back plate 6 to which the rear sections 25 and front sections 24 of the shoulder belts 3, 4 are attached. In the embodiment according to FIGS. 2A, 2B, 3 and 5 the rear sections 25 and the front sections 24 of the shoulder belts 3, 4 are connected to the hip belt 5. It can be practical to provide a transverse connection between the shoulder belts 3, 4 in order to prevent the shoulder belts 3, 4 from slipping to the side. The rear sections 25 can remain separate, as shown in FIGS. 4A and 4B, or can form a common rear section 25, as shown in FIG. 5.

Figure 2A:
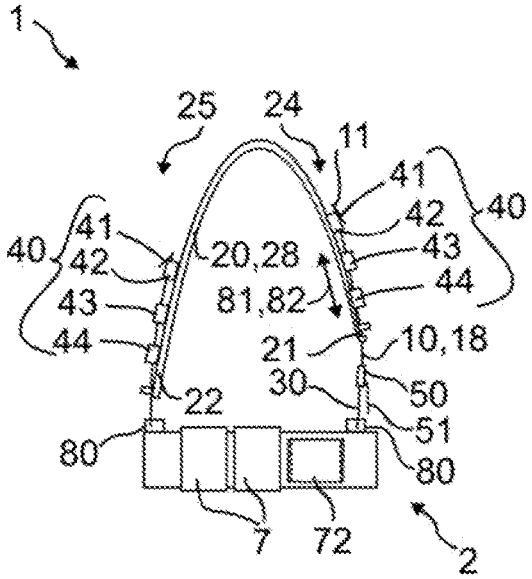
FIGS. 2A, 2B show a schematic side view of a carrying arrangement according to a second embodiment.
Figure 2B:
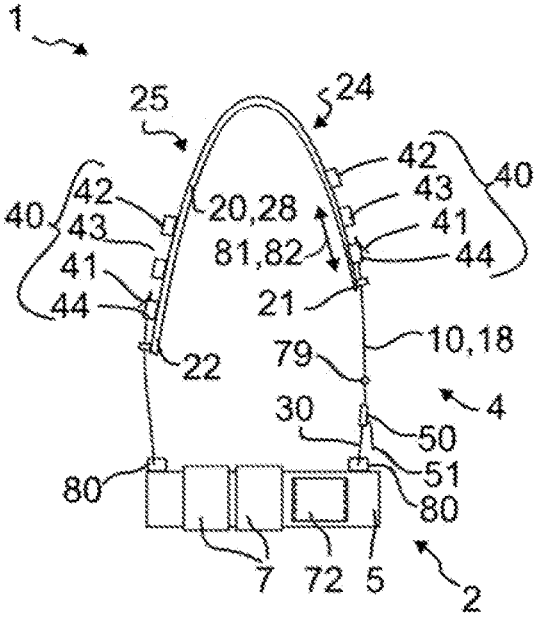

The carrying belt 2 is composed of a plurality of belt segments 10, 20, 30 which are fixed relative to one another via at least one first fixation device 40 and at least one second fixation device 50. The first fixation device 40 permits a discrete adjustment of the associated belt segments 10, 20 relative to one another, and the second fixation device 50 permits a stepless adjustment of the associated belt segments 10, 30 relative to one another. In the embodiments according to FIGS. 1A, 1B, 2A, 2B, 3 and 5, the front section 24 of the shoulder belt 3, 4 can be adjusted in terms of its length discretely via the first fixation device 40 and steplessly via the second fixation device 50. Additionally, in the embodiments according to FIGS. 2A, 2B, 3 and 5, the rear section 25 of the shoulder belt 3, 4 can also be discretely adjusted in terms of its length via a further first fixation device 40. In FIG. 1A or 2A the shoulder belt 3, 4 has been shortened discretely in terms of its length relative to FIG. 1B or 2B exclusively by the first fixation device(s) 40. The free belt end 51 protruding from the second fixation device 50 has the same length $L_{51}$ in spite of the adaptation of the carrying belt 2 to a small body size.

The detailed construction of the first fixation device 40 and the second fixation device 50 is described hereinafter by way of the embodiment according to FIGS. 4A and 4B, but applies to all of the embodiments contained in the description. The same elements are provided with the same reference signs.

Figure 4A:
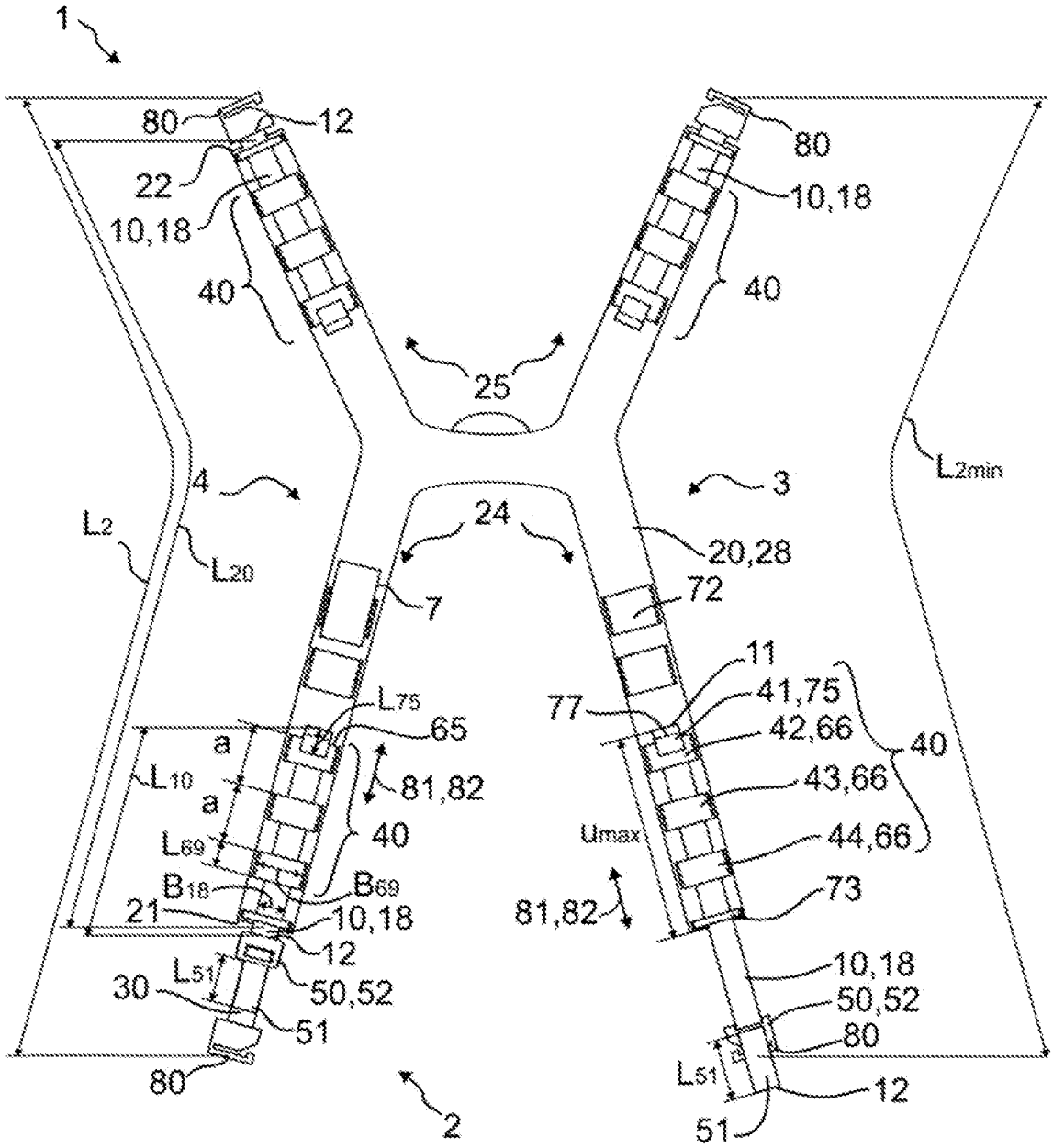
FIGS. 4A, 4B show a schematic view of a shoulder belt of a carrying arrangement according to a fourth embodiment.
Figure 4B:
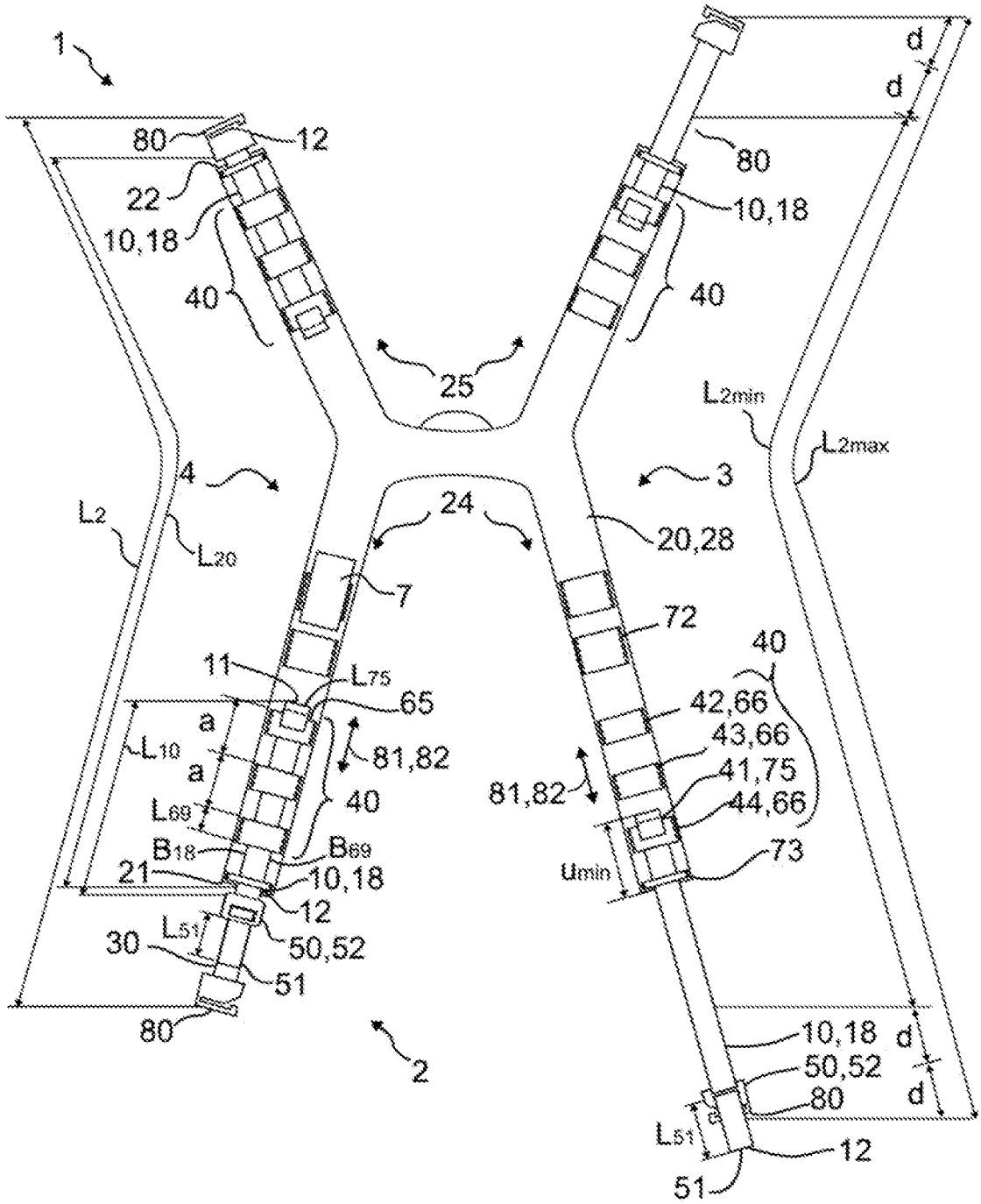

FIG. 4A or 4B show a shoulder belt 3, 4 of a carrying arrangement 1 in which the left-hand shoulder belt 3 and the right-hand shoulder belt 4 are connected together by a transverse connection. The shoulder belt 3, 4 has two front sections 24 and two rear sections 25, wherein a first fixation device 40 is arranged in all sections 24, 25. Additionally, in each case a second fixation device 50 is arranged on the front sections 24. The first fixation device 40 fixes a first belt segment 10 relative to a second belt segment 20. The second fixation device 50 fixes a first belt segment 10 relative to a third belt segment 30.

The first belt segment 10 is configured as a band 18 and has on its first end 11 a first part 41 which is configured as a holding projection 75. In an alternative variant, the holding projection 75 can also have a spacing from the first end 11 of the first belt segment 10, wherein the spacing corresponds in particular to at most 20%, quite in particular to at most 10% of the length $L_{10}$ of the first belt segment. The second belt segment 20 is configured as a cushion part 28 and has a set of second parts 42, 43, 44. The first part 41 and the set of second parts 42, 43, 44 form the first fixation device 40. In the embodiment, the set of second parts 42, 43, 44 includes three second parts 42, 43, 44 which are arranged at equal spacings from one another. A greater number of second parts 42, 43, 44 per set, in particular 4, 5 or 6 thereof, can also be provided, in particular when the spacing a between the upper faces 65 of the second parts 42, 43, 44, which corresponds to the size of the discrete increment d, is to be reduced and/or a larger adjustment length has to be provided. The possible adjustment length on the first fixation device 40 is generated by the overlap u of the first and second belt segment. By repositioning the first part 41 from the upper(most) second part 42 to the lower(most) second part 43, 44, the overlap u is reduced and thus releases a length which corresponds to the spacing a, a' of these two upper faces 65 of the second parts 42, 43, 44. By repositioning the first part 41 from the lower(most) second part 43, 44 to the upper(most) second part 42, the overlap u is increased and a length which corresponds to the spacing a, a' of these two upper faces 65 of the second parts 42, 43, 44 is fixed.

The size of the discrete increment d, that is, the spacing a, a', between the upper faces 65 of two adjacent second parts 42, 43, 44, for example, is at least 4 cm and at most 12 cm, in particular at most 6 cm. The closer the discrete increments d, the more increments are required in order to achieve a desired adjustment length and optionally a first part 41 has to be passed through all the more second parts 42, 43, 44. On the other hand, the discrete increment d should also not be greater than the adjustment length which is able to be provided steplessly. In this manner, any length $L_2$ of the carrying belt 2 can be provided from the combination of the discrete and stepless adjustment of the length. The length $L_2$ of the carrying belt 2 has a minimum discrete length $L_{2min}$ with a maximum overlap $u_{max}$ and a maximum discrete length $L_{2max}$ with a minimum overlap $u_{min}$. These discrete lengths can be adapted further by the stepless adjustment of the length.

If first fixation devices 40 are arranged on the carrying belt 2 on the front and on the rear, for example, they can both be adjusted by the same discrete increments d, so that the carrying belt 2 is not displaced to the front or rear. As a result, with a shoulder belt 3, 4 according to FIG. 4A or 4B when adjusted by a discrete increment d, in each case a length change is produced of in particular at least 8 cm and at most 24 cm, quite in particular at most 12 cm on the front section 24 and rear section 25 of the shoulder belt 3, 4. With an adjustment by two discrete increments d the length change doubles—if the discrete increments d are of the same size. With a set consisting of three second parts 42, 43, 44 which are arranged at increments of 6 cm, for example, a length change of 24 cm can be achieved thereby. This adjustment length no longer needs to be provided by the second stepless fixation device 50, so that the belt segments on the second adjusting device could be shortened overall by 24 cm. With a carrying arrangement according to the prior art without an additional discrete adjustment of the length, the entire adjustment length has to be kept on the stepless fixation device 50, whereby the length $L_{51}$ of the free belt end 51 is relatively large when setting to a small body size.

It is shown on the right-hand front section 24 of the shoulder belt 4 how the first part 41 of the first belt segment 10 and the uppermost second part 42 of the second belt segment 20 cooperate in order to fix the two belt segments relative to one another. The holding projection 75 is hooked into the uppermost bracket 66. In the embodiments shown, the holding projection 75 is configured to be hook-shaped and engages behind the bracket 66. In an alternative embodiment, the holding projection 75 can also abut against the upper face of the bracket 66, that is, not engage behind the bracket 66. The length $L_{10}$ of the first belt segment 10 is selected such that the second lower end 12 of the first belt segment 10 is still below the second belt segment 20 even when the first part 41 is fixed to the uppermost second part 42. In other words, the length $L_{10}$ of the first belt segment 10 is larger than the spacing between the upper face 65 of the uppermost second part 42 and the lower end 21 of the second belt segment 20. Such a configuration results, on the one hand, in the first belt segment 10 being fixed to the selected second part 42, 43, 44 and, on the other hand, the first belt segment 10 still being able to be guided along its length $L_{10}$ by the other second parts 42, 43, 44 of this set. The second parts 42, 43, 44, to which the first part 41 is not fixed, guide the second belt segment 20 which extends therethrough. In order to obtain a guidance of the first belt segment 10, as is shown on the left-hand front section 24, when hooking the first part 41 onto the lowermost second part 44, a guide bracket 73 is provided between the lowermost second part 44 and lower end 21 of the second belt segment 20. The guide bracket 73 has a reduced height in the longitudinal direction 82 of the second belt segment 20 relative to the second parts 42, 43, 44 which are configured as brackets 66.

The second part 42, 43, 44 which is configured as a bracket 66 is connected, in particular stitched, on its wide sides 67 to the second belt segment 20, and is open at the upper ends 68 located therebetween, whereby an open channel 69 is formed in the longitudinal direction 82 of the second belt segment 20. The top upper end forms the upper face 65 of the second part 42, 43, 44. The wide sides 67 run, in particular, parallel to a longitudinal edge of the second belt segment 20. The width $B_{69}$ of the channel 69 corresponds to the spacing of the wide sides 67. The depth of the channel 69 is approximately zero, that is, the bracket 66 and the cushion 28 of the second belt segment 20 bear flat against one another. As the depth of the channel 69 in the initial state is approximately zero, when the first part 41 is inserted through the second part 42, 43, 44 the cushion 28 initially has to be compressed and a part of the width $B_{69}$ of the channel 69 converted into a depth of the channel 69. The specified dimensions refer to the undeformed state of the second part 42, 43, 44. The length $L_{69}$ of the channel 69 corresponds to the spacing of the upper ends 68 and is measured in the longitudinal direction 82 of the second belt segment 20. The length $L_{69}$ of the channel 69 is in particular at most 50% to 100%, quite in particular at most 60% to 80%, of the width $B_{69}$ of the channel 69, that is, the channel 69 is shorter than it is wide. The first belt segment 10 which is configured as a band 18 has a width $B_{18}$ measured transversely to the longitudinal direction 81 of the first belt segment 10. The width $B_{18}$ of the band 18 is, for example, between 60% and 90% of the width $B_{69}$ of the channel 69. In this manner, the first belt segment 10 is easily guided at the sides by the wide sides 67 of the bracket 66 but at the same time can still be pushed through the channel 69 using normal manual force. The length $L_{75}$ of the holding projection 75 measured in the longitudinal direction 81 is in particular between 80% and 120%, quite in particular between 90% and 110%, of the length $L_{69}$ of the channel 69. As a result, the holding projection 75 can be inserted from below into a bracket 66 and gripped from above and pulled out from the bracket 66. The width $B_{18}$ of the band 18, for example, is 2 cm to 5 cm, in particular approximately 2.5 cm. The length $L_{69}$ of the channel 69 and the length of the holding projection 75, for example, are in each case 2 cm to 5 cm, in particular approximately 2.5 cm. The width $B_{69}$ of the channel 69, for example, is 2.5 cm to 6 cm, in particular 3 cm to 4 cm.

Figure 6:
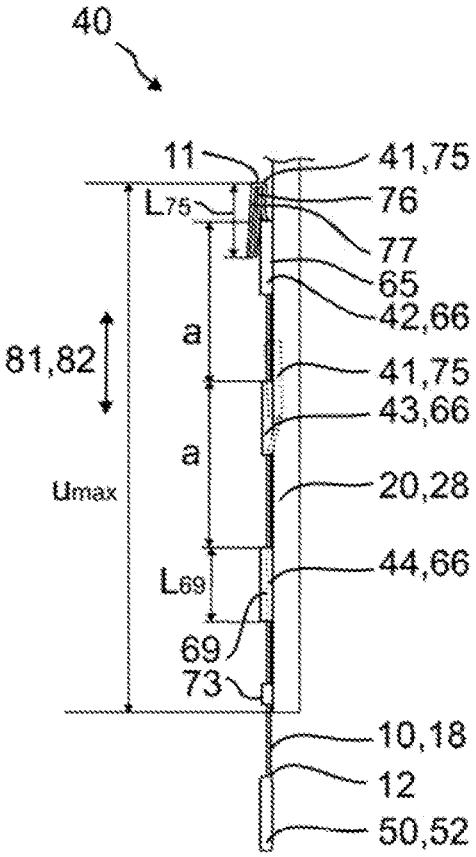
FIG. 6 shows a detailed view of a first fixation device.

The spacing of adjacent brackets 66 from one another is, in particular, between 100% and 300% of the length $L_{69}$ of the channel 69. The spacing is, in particular, 2 cm to 10 cm, in particular 2 cm to 5 cm. As a result, on the one hand, the holding projection 75 can be easily threaded into the bracket 66 and, on the other hand, the first belt segment 10 is guided tightly through the further second parts 42, 43, 44. FIG. 6 shows a detailed view of the first fixation device 40 from which it can be seen that the channel 69 running between the upper ends 68 of the bracket 66 is configured to be narrower than the thickness of the first part 41 arranged at the first end 11 of the first belt segment 10. When inserting the first part 41, the cushion 28 is compressed in the region of the bracket 66 and the channel 69 is widened thereby. After the first part 41 is pulled out from the channel 69, the cushion 28 is relieved of load again and the channel 69 becomes narrower and bears slightly against the first belt segment 10. The friction between the bracket 66, the first belt segment 10 and the cushion 28 of the second belt segment 20 reduces the tendency for the first belt segment 10 to slip in the channel 69. In FIG. 6 it can be identified that the first belt segment 10, which is configured as a band 18, is wound back on its first end 11 and thus is configured to be thickened. A seam 77 running in the upper half, in particular in the upper third, of the winding and transversely to the longitudinal direction 81, holds the winding together and forms the first part 41 which is configured as holding projection 75. A plastics plate 76 can be wound-in therewith, in order to increase the stiffness of the holding projection 75 further. Alternatively, it is possible to provide more winding turns which are connected, in particular, together, for example by adhesive or stitching. Due to the increased stiffness, the holding projection 75 can be pushed more easily through the narrow channel 69. Moreover, the holding projection 75, which is configured in a hook-shaped manner in the embodiments, is prevented from being folded over.

The second fixation device 50 fixes the first belt segment 10, which is configured as a band 18, relative to a third belt segment 30. For displaying the different variants, the left-hand front section 24 of the shoulder belt 3 and the right-hand front section 24 of the shoulder belt 4 are shown configured differently in FIG. 4A or 4B. The third belt segment 30 can be part of the shoulder belt 3, 4, as on the right-hand front section 24 of the shoulder belt 4 shown by way of example in FIG. 4A or 4B or in FIG. 1A or 1B and 2A or 2B. The third belt segment 30 can alternatively also be part of the hip belt 5, as shown by way of example on the left-hand front section 24 of the shoulder belt 3 in FIG. 4A or 4B or in FIG. 3. The third belt segment 30 can accordingly be configured as a band 18 or cushion part 28. The second fixation device 50 can be formed by a buckle 52, in particular a ladder lock buckle, clip or similar element. At least one free belt end 51, which can be pulled in order to reduce steplessly the length $L_2$ of the carrying belt, protrudes from the second fixation device 50. As long as no adjustment is carried out on the second fixation device 50, the length $L_{51}$ of the free belt end 51 protruding therefrom does not change. For the stepless adjustment of the length it is irrelevant whether the free belt end 51 is associated with the first belt segment 10 or the third belt segment 30, that is, the second fixation device 50, in particular the buckle 52, clip or the like, is connected to the one or the other belt segment so as to be unchangeable in terms of length. Only the position at which the free belt end 51 is arranged on the carrying belt 2, and how this is oriented relative to the carrying belt 2, is changed. If the free belt end 51 is configured on the same belt segment, as well as the first part 41, however, there is the option of the user simply pulling on the free end—as is usual in conventional carrying belts—instead of hooking up the first part 41 by one or more discrete increments d. In order to avoid a long free belt end 51 being produced as a result of this behavior, it is possible to provide on this belt segment a stop 79 which does not hinder the discrete adjustment of the length but cannot pass the second fixation device 50. As a result, the adjustment length of the stepless adjustment of the length and the free belt end 51 associated therewith is limited. In the simplest case, this incorrect operation can be avoided when the free belt end 51 of the second fixation device 50 is not configured on the same belt segment as the first part 41 of the first fixation device 40.

Figure 3:
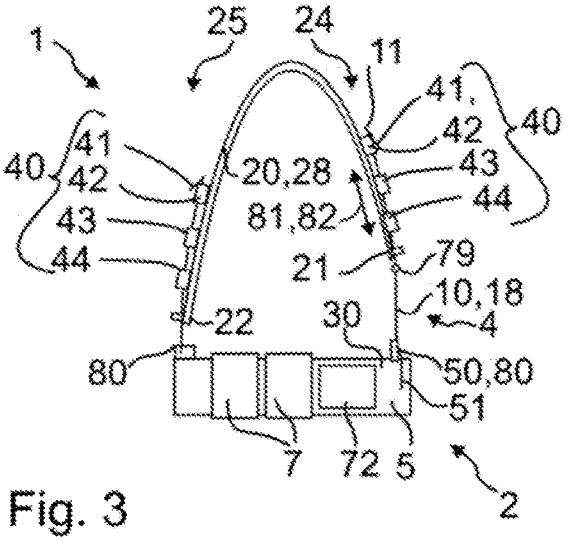
FIG. 3 shows a schematic side view of a carrying arrangement according to a third embodiment.

In an embodiment according to FIG. 3, the free belt end 51 is configured on the first belt segment 10. A stop 79 which limits the first belt segment 10 to be pulled through to a specific length can be provided on the first belt segment 10, in order to avoid a long belt end 51. The second fixation device 50 is configured as a reversible partition location between the shoulder belt 3, 4 and the hip belt 5. In all other embodiments the shoulder belt 3, 4 can also be connected, in particular hooked on, to the hip belt 5 at a reversible partition location 80.

Figure 7A:
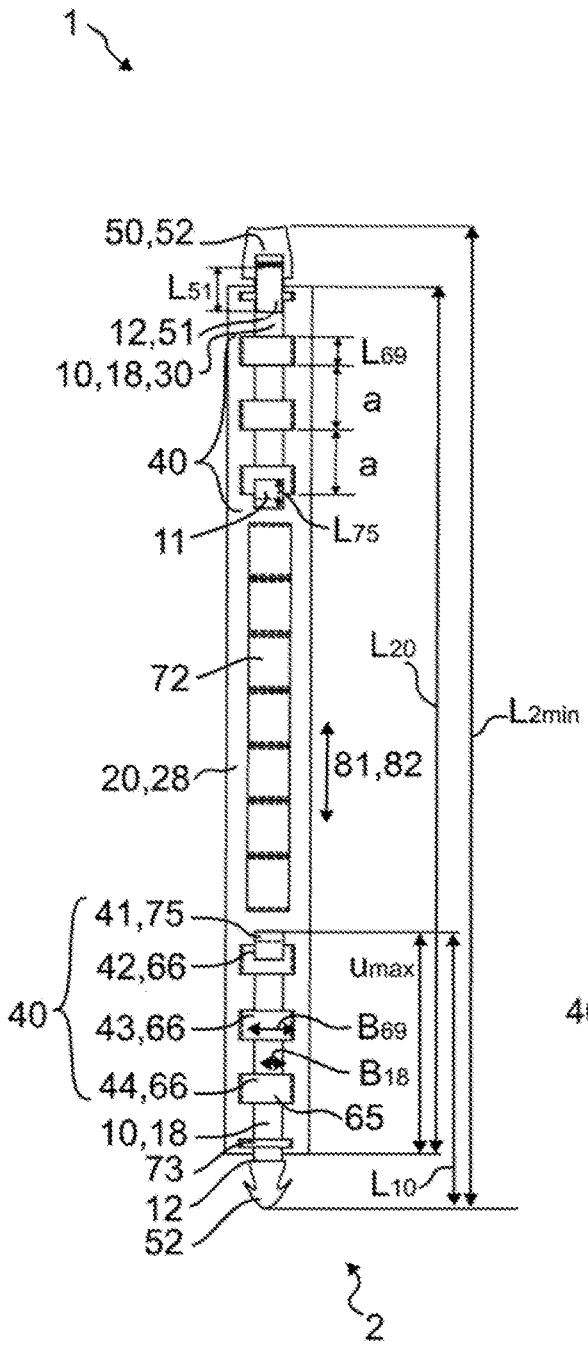
FIGS. 7A, 7B show a schematic view of a hip belt of a carrying arrangement according to a fifth embodiment.
Figure 7B:
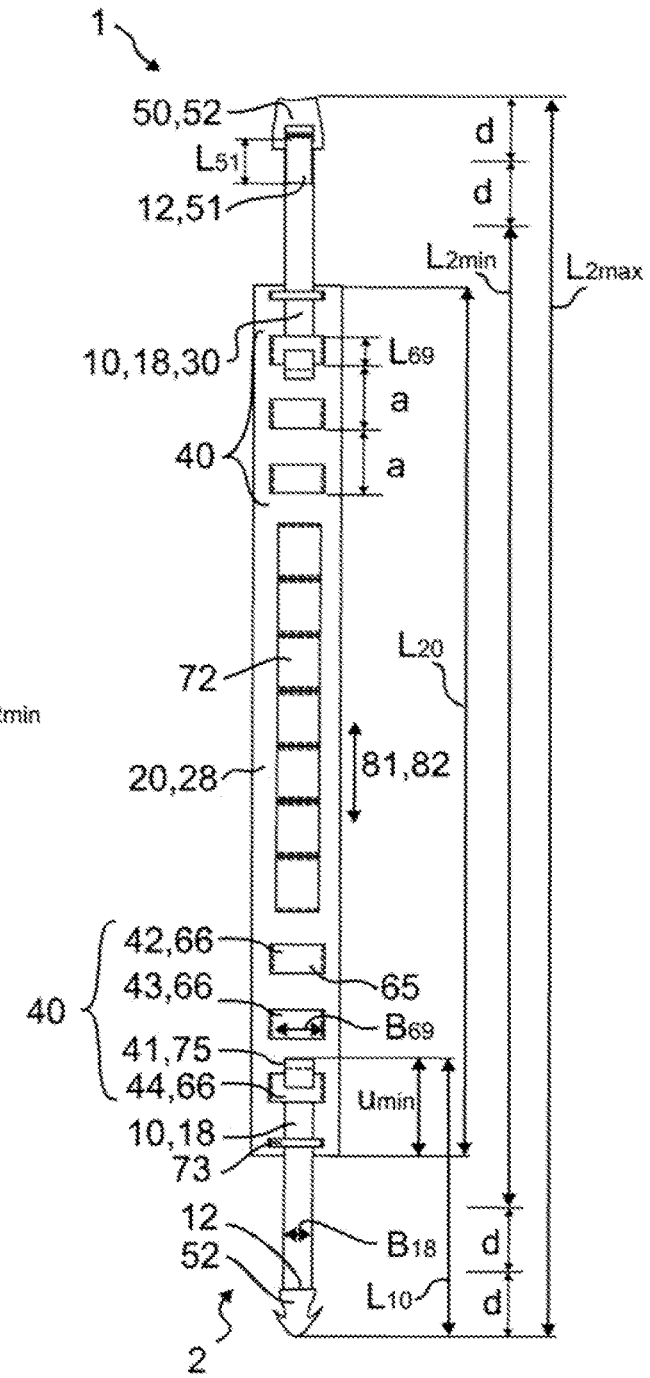

In an embodiment according to FIG. 7A or 7B, the hip belt 5 can be adjusted discretely and steplessly in order to be adapted to the body size of a user. The hip belt 5 can be part of the carrying arrangements 1 according to the embodiments according to FIGS. 1A, 1B, 2A, 2B, 3, 4A and 4B and form the carrying belt 2 together with the shoulder belt 3, 4. Alternatively, the hip belt 5 can also form the carrying belt 2 alone. At least one first fixation device 40 and one second fixation device 50 are arranged on the hip belt 5. The second belt segment 20 has at its ends 21, 22 in each case a set of second parts 42, 43, 44, which form a first fixation device 40, in each case with a first part 41 of a first belt segment 10. The one first belt segment 10 and the other first belt segment 10 can be fixed to one another via a second fixation device 50, in particular in the form of a buckle 52. At least one free belt end 51, which can be pulled in order to reduce steplessly the length $L_2$ of the carrying belt 2, protrudes from the second fixation device 50. One of the two first belt segments 10 forms the third belt segment 30. The statements relative to the first fixation device 40 and to the second fixation device 50 relating to the embodiments already disclosed can also be applied to this embodiment. In order to avoid duplication, reference is made to these points in the description of the figures, wherein the same elements are provided with the same reference signs.

It is understood that the foregoing description is that of the preferred embodiments of the invention and that various changes and modifications may be made thereto without departing from the spirit and scope of the invention as defined in the appended claims.

The invention claimed is:

1. A carrying arrangement for carrying loads by a user, the carrying arrangement comprising:

a carrying belt wearable on a body of the user;

said carrying belt having a length which is adjustable by an adjustment length to be adapted to a body size of the user and/or a carrying situation;

said carrying belt being formed by at least first, second and third belt segments positioned relative to one another to adjust said length of said carrying belt;

said first belt segment being adjustable in discrete increments relative to said second belt segment and said third belt segment being steplessly adjustable relative to at least one of said first belt segment and said second belt segment; and, said adjustment length being a serial combination of a discrete length adjustment and a stepless length adjustment.

2. The carrying arrangement of claim 1, further comprising:

a first fixation device configured to fix said first and second belt segment against a movement relative to one another;

said first fixation device being formed by a first part and second parts compatible with said first part;

said first belt segment having said first part and said second belt segment having at least two of said second parts; and, said two second parts being arranged at a discrete spacing to one another in a longitudinal direction of said second belt segment.

3. The carrying arrangement of claim 2, wherein said first belt segment is formed by a flat band-shaped section and said first part of said first fixation device is arranged on said first belt segment.

4. The carrying arrangement of claim 2, wherein said first part of said first fixation device is configured as a holding projection.

5. The carrying arrangement of claim 4, wherein said holding projection is configured integrally on said first belt segment.

6. The carrying arrangement of claim 4, wherein said holding projection is configured in a hook-shaped manner having a predetermined length and partially overlapping the second part with a part of said predetermined length in the longitudinal direction of said second belt segment.

7. The carrying arrangement of claim 1, further comprising:

a first fixation device configured to fix said first and second belt segments against a movement relative to one another;

a second fixation device fixing said third belt segment against a movement relative to said first belt segment or a movement relative to said second belt segment;

a free belt end having a length protruding from said second fixation device; and, said length of said free belt end being changed as a function of a position of said second fixation device which can be steplessly displaced relative to a longitudinal direction of the first belt segment or the second belt segment.

8. The carrying arrangement of claim 7, wherein a belt segment associated with said free belt end has a length of less than 50 cm.

9. The carrying arrangement of claim 7, wherein a belt segment associated with said free belt end has a length of less than 40 cm.

10. The carrying arrangement of claim 7, wherein a belt segment associated with said free belt end has a length of less than 25 cm.

11. The carrying arrangement of claim 1, wherein at least four first belt segments are fixed to said second belt segment in discrete increments.

12. The carrying arrangement of claim 1, wherein said carrying belt comprises a shoulder belt and a hip belt; said shoulder belt has at least said first belt segment and said second belt segment; and, said third belt segment is configured on said hip belt.

13. The carrying arrangement of claim 1, wherein said carrying belt comprises a shoulder belt and a hip belt; said shoulder belt has at least said first belt segment and said second belt segment; and, said third belt segment is part of said shoulder belt and is connected to said hip belt.

14. The carrying arrangement of claim 13, wherein the third belt segment is connected to said hip belt so as to be unchangeable in terms of length.

15. The carrying arrangement of claim 1, wherein said carrying belt is a shoulder belt and/or a hip belt.

16. The carrying arrangement of claim 1, wherein said carrying arrangement is provided for carrying tools and/or implements.

17. A carrying arrangement for carrying loads by a user, the carrying arrangement comprising:

a carrying belt wearable on a body of the user:

said carrying belt having a length which is adjustable by an adjustment length to be adapted to a body size of the user and/or a carrying situation;

said carrying belt being formed by at least first, second and third belt segments positioned relative to one another to adjust said length of said carrying belt;

said first belt segment being adjustable in discrete increments relative to said second belt segment and said third belt segment being steplessly adjustable relative to at least one of said first belt segment and said second belt segment;

a first fixation device configured to fix said first and second belt segment against a movement relative to one another;

said first fixation device being formed by a first part and second parts compatible with said first part;

said first belt segment having said first part and said second belt segment having at least two of said second parts;

said two second parts being arranged at a discrete spacing to one another in a longitudinal direction of said second belt segment; and, wherein said second belt segment has a cushion section and the two second parts are arranged in said cushion section of said second belt segment; and, a cushion of said cushion section is compressed for changing a discrete adjustment of said length.

18. A carrying arrangement for carrying loads by a user, the carrying arrangement comprising:

a carrying belt wearable on a body of the user;

said carrying belt having a length which is adjustable by an adjustment length to be adapted to a body size of the user and/or a carrying situation;

said carrying belt being formed by at least first, second and third belt segments positioned relative to one another to adjust said length of said carrying belt; and, said first belt segment being adjustable in discrete increments relative to said second belt segment and said third belt segment being steplessly adjustable relative to at least one of said first belt segment and said second belt segment; and, wherein at least two first belt segments can be fixed to said second belt segment in discrete increments.

19. The carrying arrangement of claim 18, wherein at least three first belt segments are fixed to said second belt segment in the discrete increments.

* * * * *